US005630737A

United States Patent [19]

Dupont

[11] Patent Number: 5,630,737

[45] Date of Patent: May 20, 1997

[54] JUNCTION CONNECTOR FOR PERMANENTLY CONNECTING ELECTRICAL CABLES

[75] Inventor: André Dupont, Gevrey Chambertin, France

[73] Assignee: The Whitaker Corporation, Wilmington, Del.

[21] Appl. No.: 587,117

[22] Filed: Jan. 11, 1996

[30] Foreign Application Priority Data

Jan. 12, 1995 [FR] France ..... 95 00470

[51] Int. Cl.[6] ..... H01R 11/09

[52] U.S. Cl. ..... 439/797; 439/814; 439/431

[58] Field of Search ..... 439/411, 412, 439/431, 433, 434, 435, 797, 798, 800, 805, 810, 811

[56] References Cited

U.S. PATENT DOCUMENTS

| | | | |
|---|---|---|---|
| 3,864,013 | 2/1975 | Levy | 439/797 |
| 4,269,465 | 5/1981 | Mueller | 339/95 R |
| 4,684,196 | 8/1987 | Smith et al. | 439/411 |
| 4,829,146 | 5/1989 | Duve | 174/94 R |
| 5,000,705 | 3/1991 | Kinka et al. | 439/805 |
| 5,137,476 | 8/1992 | Noble | 439/797 |

FOREIGN PATENT DOCUMENTS

| | | | |
|---|---|---|---|
| 570307 | 7/1945 | United Kingdom | 439/797 |
| 1422935 | 1/1976 | United Kingdom . | |
| 2266628 | 11/1993 | United Kingdom . | |
| 2272586 | 5/1994 | United Kingdom . | |

*Primary Examiner*—David L. Pirlot
*Assistant Examiner*—Tho Dac Ta

[57] ABSTRACT

This invention relates to a junction connector for permanently connecting electric cables, wherein its sleeve comprises a bore passing longitudinally therethrough, a part of the wall of this bore, extending over an angle at the center greater than 180°, being provided with longitudinal ribs projecting radially towards the center; aligned tapped holes, made from the outside, open out in the bore opposite the central generatrix of its ribbed part; and locking bolts whose end is in the form of a spherical cap and incorporating a cleavable head, are screwed in the tapped holes to assemble the cables sleeve.

7 Claims, 2 Drawing Sheets

JUNCTION CONNECTOR FOR PERMANENTLY CONNECTING ELECTRICAL CABLES

BACKGROUND OF THE INVENTION

1. Field of the Invention

The present invention relates to junctions or splicing connectors for permanently connecting medium-voltage electric cables incorporating a circular core wire. Such junctions, for example, are used for cables whose section is included between 35 and 300 $mm^2$ and they concern the permanent connection of cables of overhead or underground networks.

2. Description of the Prior Art

Up to the present time, such connections have been made by means of a sleeve, in the longitudinal bore of which are engaged the two opposite ends of the two cables to be connected. Once these ends are engaged in the sleeve, deep stampings are made in the sleeve by means of a hydraulic press or the like, in order to deform it to assemble the two cables permanently.

It will be readily appreciated that this process of assembly involves the use of a hydraulic installation for supplying pressure to the deep-stamping tool. Such an installation comprises an electric motor or heat engine for driving the hydraulic pump. Moreover, it is necessary to adapt the stamping tool to the type of junction used as a function of the diameters of the cables to be connected. It is therefore possible, on the one hand, for errors to be made in the choice of the appropriate tool and, on the other hand, for this tool or the hydraulic installation to deteriorate, as all of this equipment is used on open land and sometimes in mud or sand. The junctions are therefore sometimes defective, which is extremely detrimental, particularly when the cables are buried.

SUMMARY OF THE INVENTION

It is an object of the improvements forming the subject matter of the present invention, to overcome these drawbacks and to produce a junction which does not require the use of considerable, sophisticated equipment to make the permanent connection.

It is also an object to provide a splicing connector that ensures a reliable contact with stranded conductor cables, over its lifetime. Many electrical power cables for power transmission are made of stranded aluminium alloy cables. One problem of connecting to aluminium in particular (although it occurs to varying degrees with other metals), is that relaxation of the metal due to thermal and mechanical solicitation, and formation of oxide layers at the contact surfaces, may impair electrical conductivity of conventional splicing connectors. The same sort of problem can occur for cables of a diameter smaller than the largest diameter accepted by the connector, as some strands of a smaller cable may move to unoccupied areas of the connector, thereby relaxing contact pressure.

To that end, the junction according to the invention is characterized in that its sleeve comprises a bore passing longitudinally therethrough, a part of the wall of this bore extending over an angle at the centre greater than 180°, being provided with longitudinal ribs projecting radially towards the centre; in that aligned tapped holes, made from the outside, open out in the bore opposite the central generatrix of its ribbed part; and in that locking bolts whose end is in the form of a spherical cap and incorporating a cleavable head, are screwed in said holes to assemble the cables and sleeve.

Other objects are achieved by providing a splicing connector with a longitudinal bore having longitudinal extending ribs therein, one or more of the ribs having a height greater than adjacent ribs such that lateral movement of conducting strands of a conductor for connection thereto, is made more difficult.

DETAILED DESCRIPTION OF THE PREFERRED EMBODIMENT

Figure 1:
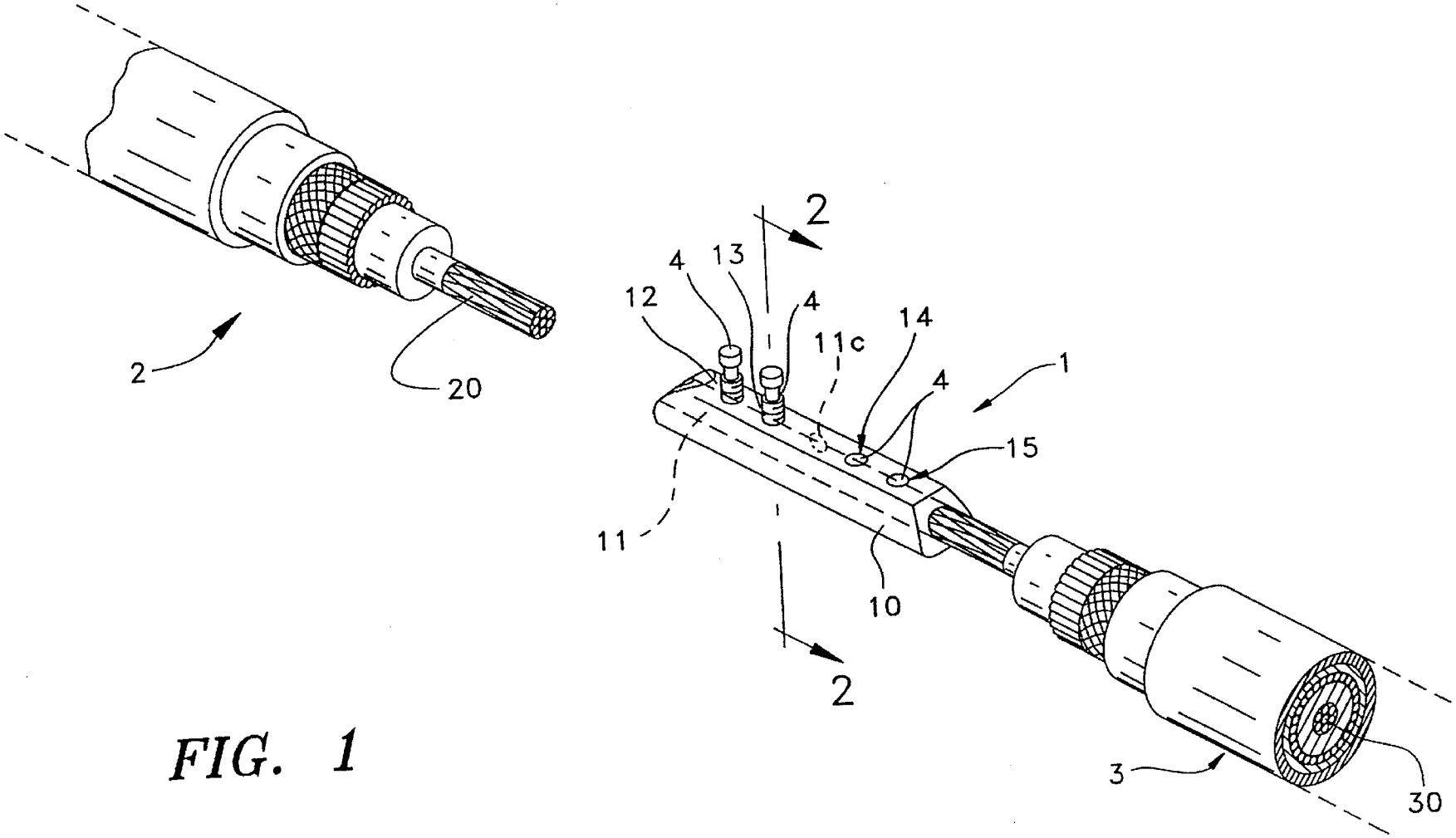
FIG. 1 is an exploded view in perspective of a junction according to the invention and of the naked ends of the two cables to be connected.

Referring now to the drawings, FIG. 1 firstly illustrates a junction according to the invention under general reference 1, intended to connect permanently to two cables 2,3 respectively.

The junction 1 is in the form of a tubular sleeve 10 provided with a longitudinal bore 11 which traverses it right through. Aligned, radial, tapped holes, referenced 12,13,14 and 15 open out in the bore 11 opposite one of the generatrices thereof.

Figure 2:
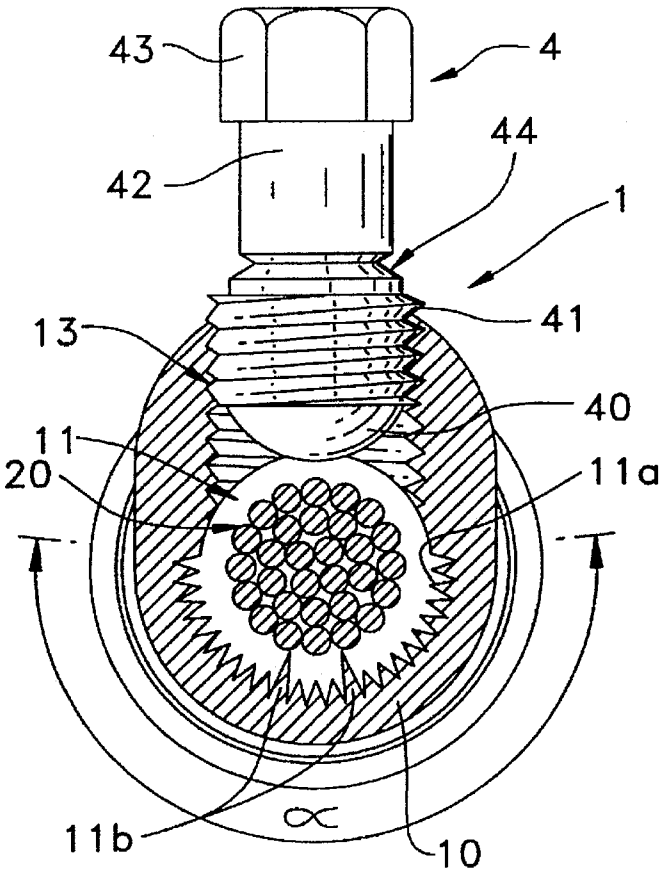
FIG. 2 is a section along 2—2 of FIG. 1, i.e. before the locking screws are tightened.

As illustrated in FIG. 2, the wall of the bore 11 is provided preferably symmetrically with respect to the above-mentioned generatrix facing the opening of each tapped hole 12,13,14,15 with a certain number of longitudinal ribs 11*a* oriented longitudinally and projecting radially towards the centre. That zone of the wall of the bore 11 on which the ribs extend is provided over an angle at the centre $\alpha$ greater than 180°. The height of certain of the ribs, referenced 11*b*, may be provided to be greater than that of the others 11*a*. This helps to prevent conducting strands of the conductor to migrate around the periphery of the cavity, or to move with respect to each other, particularly when the connector is subject to mechanical or thermal solicitation. Electrical connection over the lifetime of the connector is thereby improved.

Figure 3:
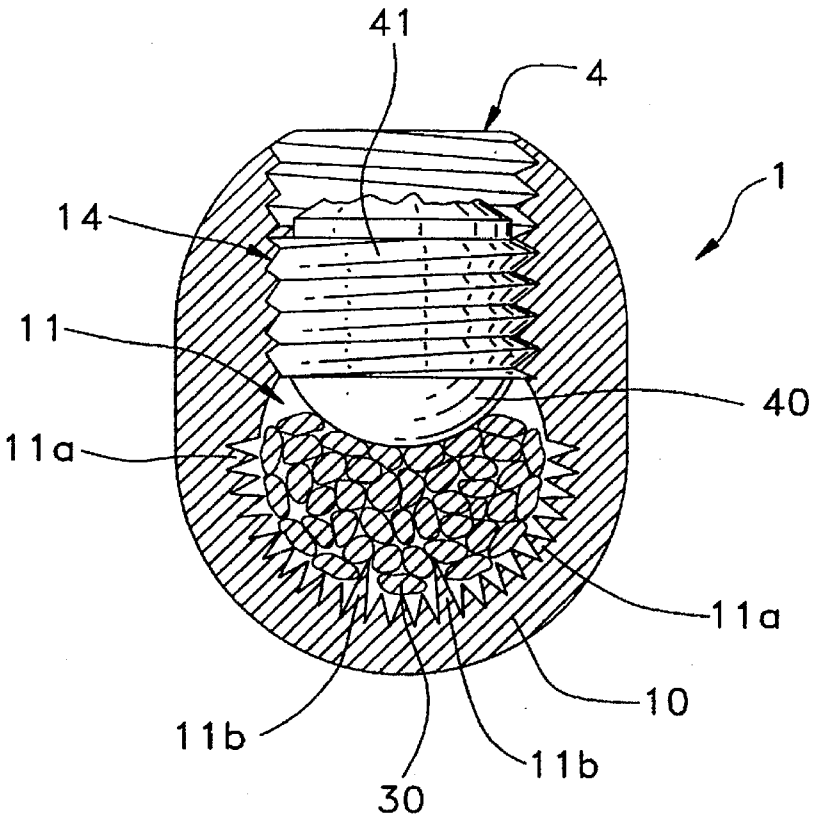
FIG. 3 is a view similar to that of FIG. 2, but showing a locking screw tightened on the cable after its cleavable head has broken.

In each tapped hole 12,13,14,15 there is screwed a locking screw 4 whose free end is intended to come into contact with core 20 of the cable 2 and is in the form of a spherical cap 40 which terminates its threaded body 41. The threaded body 41 extends into a smooth core 42 leading to a hexagonal or like head 43. Between the core 42 and the body 41 is provided a notch 44 which determines a zone of least resistance of the screw. Once the naked part 20 of cable 2, or naked part 30 of cable 3, has been engaged in bore 11, screws 4 are tightened, thus engaging in bore 11, as illustrated in FIG. 3, compressing the multi-strand or cabled circular core of each cable, with the result that the strands thereof move with respect to one another, while the peripheral strands are penetrated by the saw-tooth ribs 11*a* and 11*b*. In this way, the oxide layer which has been formed on the strands on the periphery and within the cable is broken, so that the relative insulation of these strands with respect to one another is reduced. Each screw or bolt 4 is tightened until the zone of least resistance created by notch 44 breaks under the torsional effort applied to head 43. The top of body 41 of each bolt is arranged so that, at that moment, it lies slightly inside the corresponding tapped hole, as illustrated in FIG. 3. In this way, nothing projects from the sleeve 10, so that it resumes the shape of the known sleeve in which the cables are immobilized by deep stamping. Consequently, a complex insulation member may be made around junction 1 and the cables that it connects, in the same manner as that presently used for deep-stamping junction connectors.

Of course, cables 2 and 3 as well as junction 1 and screws 4 are made either of copper or, preferably of aluminium. Being given that cores 20,30 of cables 2,3 may be of cross-sectional area between 35 and 300 $mm^2$, it is necessary, depending on the diameter of the cables to be connected, to use screws of different lengths, respecting the characteristic set forth hereinabove whereby each screw breaks just inside the tapped holes.

It is possible for bore 11 to present a transverse partition 11*c* which divides this bore into two equal or unequal parts.

It must, moreover, be understood that the foregoing description has been given only by way of example and that it in no way limits the domain of the invention which would not be exceeded by replacing the details of execution described by any other equivalents.

I claim:

1. Splicing connector for permanently connecting bared ends of stranded conductor cables comprising:

a sleeve pierced with a bore which passes longitudinally therethrough to receive the bare ends of two cables to be connected;

on a part extending over an angle at the centre greater than 180°, the wall of said bore presents longitudinal ribs which project radially towards the centre;

a series of tapped holes disposed in alignment, open out in said bore, substantially opposite the central generatrix of the ribbed part of said bore; and inside each tapped hole is engaged a locking bolt ensuring assembly of the cables and the sleeve, wherein the locking bolt comprises a cleavable head and an end in the form of a spherical cap.

2. Connector according to claim 1, characterized in that the height of certain of the ribs in the bore of the sleeve is greater than that of the other ribs.

3. Splicing connector for connecting bared ends of stranded conductor cables comprising:

a sleeve pierced with a bore which passes longitudinally therethrough to receive the ends of two cables to be connected;

on a part extending over an angle at the centre, the wall of said bore presents longitudinal ribs which project radially towards the centre;

a series of tapped holes disposed in alignment, open out in said bore, substantially opposite the central generatrix of the ribbed part of said bore;

inside each tapped hole is engaged a bolt ensuring assembly of the cables and the sleeve; and wherein the height of certain of the ribs in the bore of the sleeve is greater than that of the other ribs.

4. Connector according to any one of claims 1–3, characterized in that a transverse partition divides the bore of the sleeve into two parts.

5. Connector according to any one of claims 1–3, characterized in that the length of the bolts which is a function of a diameter of the cores of the cables, is calculated so that each of said bolts breaks just inside the tapped holes with respect to the outside.

6. Connector according to claim 3 wherein the angle is greater than 180°.

7. Connector according to claim 3 wherein the bolt has a substantially spherical end for crushing against the cable conductors.

* * * * *